US005113784A

United States Patent [19]

Forselius

[11] Patent Number: 5,113,784

[45] Date of Patent: May 19, 1992

[54] MULTI-TONE WHISTLE

[76] Inventor: Randall A. Forselius, 2767 S. Langley Crt., Denver, Colo. 80210

[21] Appl. No.: 623,590

[22] Filed: Dec. 7, 1990

[51] Int. Cl.[5] ..... G10K 5/00

[52] U.S. Cl. ..... 116/137 R; 84/330; 116/141; 446/206

[58] Field of Search ..... 116/137 R, 141; 84/330; 446/202–208

[56] References Cited

U.S. PATENT DOCUMENTS

| | | | |
|---|---|---|---|
| 649,576 | 5/1900 | Hatch | 446/205 |
| 2,529,661 | 11/1950 | Millstein | 84/330 |
| 3,029,554 | 4/1962 | Mobley | 446/207 |
| 4,207,703 | 6/1980 | Saso | 446/206 |
| 4,709,651 | 12/1987 | Lance | 116/137 R |

FOREIGN PATENT DOCUMENTS

| | | | |
|---|---|---|---|
| 0380098 | 10/1922 | Fed. Rep. of Germany | 84/330 |
| 0022309 | of 1911 | United Kingdom | 446/204 |

*Primary Examiner*—William A. Cuchlinski, Jr.
*Assistant Examiner*—W. Morris Worth
*Attorney, Agent, or Firm*—Gregory W. O'Connor; Edna M. O'Connor

[57] ABSTRACT

A simple toy whistle includes a mouthpiece and multiple resonant chambers. In order to permit single notes to be played by one resonant chamber, while preventing the other chambers from producing audible tones when the whistle is played, each such chamber is provided an additional opening. This opening is provided with an annular boss so that it can be sealed by the pad of the user's thumb or finger when the corresponding chamber is to resonate.

7 Claims, 1 Drawing Sheet

MULTI-TONE WHISTLE

BACKGROUND OF THE DISCLOSURE

The disclosure relates to a novelty type whistles, such as that given to children as a trinket or premium. More specifically, the disclosure relates to simple molded plastic whistles which can produce multiple audible tones, that is can be played lke a musical instrument, although with limited tonal range relative to serious musical instruments. Most toy whistles can produce only one tone, or if such whistle is provided with more than one resonant air cavity, the whistle can produce only a simple chord of tones when blown. One such known whistle, similarly constructed to the preferred embodiment of the subject invention, comprises a simple two shell construction which forms a series of three sealed resonant chambers, the mouthpiece has a single air receiving opening connected to these sealed cavities. When the user blows into the mouthpiece, all three cavities can be made to resonate at three audible frequencies, this produces a satisfying whistle sound. However, any child can become quickly bored of this. Even when the whistle is blown loudly or softly, or rhythmically, the user soon recognizes the limited range of creative expresion available, and hopefully for anyone within hearing, such explorations will soon cease. Even with the provisions of multiple, even turned resonant chambers, there is no practical way to selectively play less than all of the tones producible by the chambers.

OBJECTS OF THE INVENTION

Accordingly, it is an object of the invention to provide a simply constructed whistle which permits the user to selectively produce a single tone or more than one tone at a time, thus expanding the musical capabilities of the conventional toy whistle.

BRIEF DESCRIPTION OF THE INVENTION

Provided is a whistle capable of selectively producing a single note or more than one note at any particular time comprising a plurality or resonant chambers, a mouthpiece with this plurality of resonate chambers connected to the mouthpiece. The mouthpiece has an air receiving opening and a second opening arranged relative to the mouthpiece such that when the user blows through air receiving opening, the air in the resonating chambers can be caused to vibrate at an audible frequency, a hole in each said chambers positioned such that each said hole can be selectively closed by a digit of the user, whereby, when a hole in an chamber is not closed, the chamber will not produced an audible sound, but when the hole in a chamber is closed, that chamber can produce an audible tone.

This whistle can best be constructed of two molded pieces, each piece having an end defining one portion of the mouthpiece, a wall defining portion, and edge portions sized for mutual engagment with the edge portions of the other of the pieces, such that when so engaged, the wall defining portions and the edge portions form the plurality of chambers.

DETAILED DESCRIPTION OF THE PREFERRED EMBODIMENT

Figure 1:
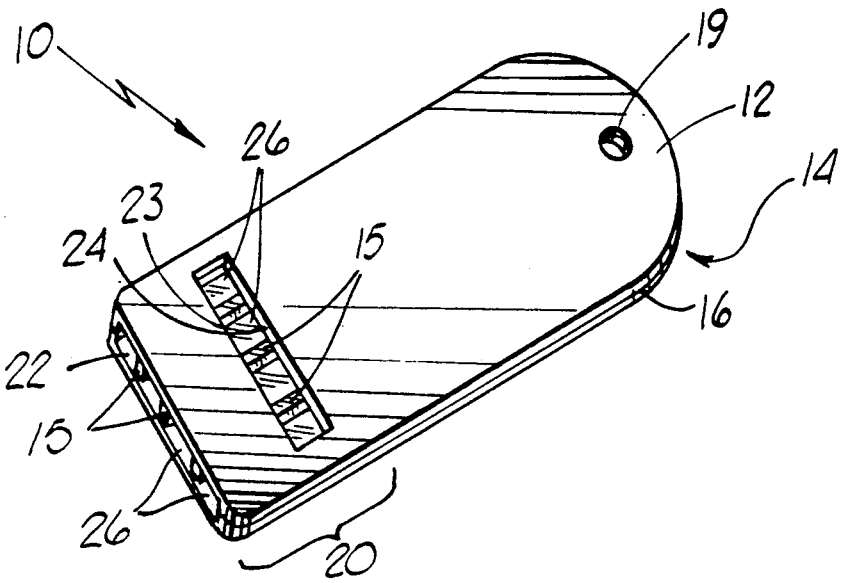
FIG. 1 is a perspective view of the whistle showing the mouthpiece end.

The whistle 10 is made of two interfitting halves 12 and 14 which are joined along a peripheral seam 16. Each half includes an end portion which defines half of the end walls and one main wall of the mouthpiece 20. These halves can be made of injection molded polystyrene or some other easily joined injection molding compound. Alternately, the whistle could be of stamped or of molded metal. The mouthpiece 20 has a first opening 22 through which the user blows to operate the whistle as will be set forth. The mouthpiece 20 further includes a second opening 23 connected to the first and arranged essentially at a right angle thereto. The second opening includes a beveled rear wall 24 which can divide the path of air as it exits from the mouthpiece through the second opening as will be detailed.

The interfitting halves have further upstanding walls 15 which divide the otherwise hollow interior created by the interfitted halves into a series of chambers which are each connected to the mouthpiece 20. This lower half also includes a trapezoid shaped enlarged portion 17 which together with the lid like top shell 12, orms the interior volume of the whistle. The lower half 14 is preferably molded with the three walls 15 projecting from the upper surface.

Figure 2:
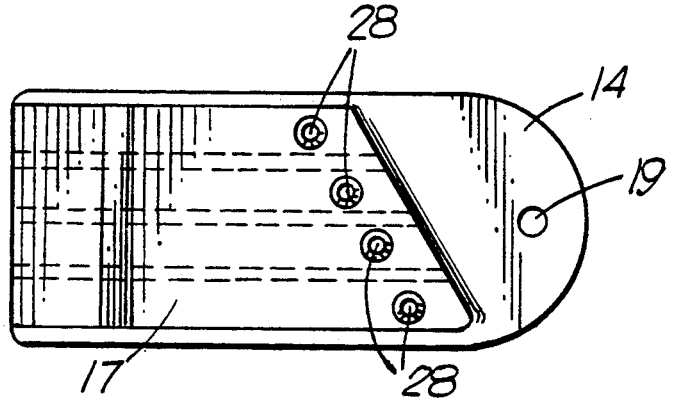
FIG. 2 is a plan view showing the back side of the whistle of FIG. 1.
Figure 3:
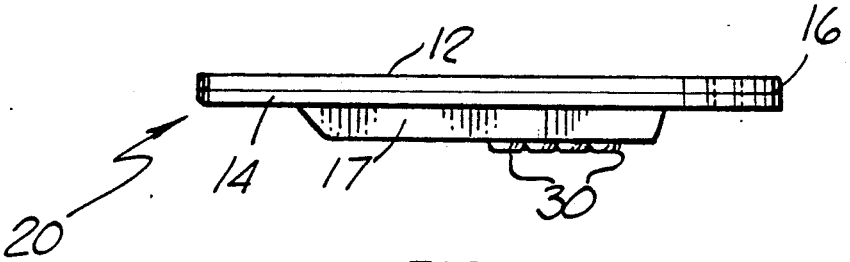
FIG. 3 shows the whistle of FIG. 1 from the right side edge.

The lower half also includes a series of selectively closable openings 28, one each being provided into each of the cavities 26. Each opening 28 is provided with a projecting annular rim or boss 30 which permits the user of the whistle to easily seal off the opening 28 as will be discussed. As can be seen in FIG. 2, these openings, and their annular bosses, are not only space laterally, but also staggered or offset lengthwise from one another to premit the user to more easily select the correct boss against which to press a fingertip or a thumbtip.

The overall construction is less than about 3½ inches long and ½ inches thick. An end opposite from the mouthpiece 20 can include a hole to receive a string or chain for easy carrying.

The operation of the whistle is remarkably easy to use to play simple tunes. The chambers 26 can be sized to produced middle C, D, E, and F. When the opening 28 is not sealed by a finger of the user, no audible tone is produced. However, when an opening 28 is sealed, the corresponding cavity or chamber can be made to resonate as the air, flowing over the bevelled wall 24 of the second opening, alternatively flows out the opening 23 or into the chamber, compressing the air in the chamber slightly. This alternate flow takes place at the resonant frequency of the sealed chamber. In contrast, no such alternating flow and thus no audible resonance occurs in the chambers that are vented through the unsealed openings 28.

It has been found that providing the openings 28 on the bottom of the whistle can aid playing the whistle. The user can hold the whistle with the index finger across the top of the top shell 12 while blowing into the mouthpiece. This also leaves the flat area on the other side for an advertising message. The pad of the corresponding thumb can be moved to seal the openings 28 quite easily. Or if desired, the whistle can be turned over so the pad of the index finger can be used to seal the openings quite easily. Even those unskilled in music can quickly adapt to the unusual playing configuration. The staggered or arrayed arrangement of the annular bosses space the holes further apart from one another than otherwise, and relative positions can be quickly associated with the relative tone of the desired note.

While a generally planer shape with rounded end is shown, other shaped and configurations are possible within the teachings of this invention. Rectangular shapes, even simulative or figurative shapes which maintain the functional features can be easily executed.

I claim:

1. A whistle capable of selectively producing more than one tone comprising a plurality of resonant chambers, a mouthpiece, said plurality of resonant chambers connected to said mouthpiece, said mouthpiece having an air receiving opening and a second opening arranged relative to said mouthpiece such that when the user blows through air receiving opening, the air in said resonating chambers can be caused to produce an audible tone, a single hole in each said chambers positioned such that each said hole can be selectively closed by a digit of the user, said chambers being sized such that when a hole in a chamber is not closed and the user blows so as to normally to cause said chamber to produce said audible tone, the chamber will not produce said audible tone, but when the hole in a chamber is closed, that chamber can produce said audible tone.

2. A whistle as is claim 1 wherein said whistle is constructed of two molded pieces, each piece having an end defining one portion of the mouthpiece, a wall defining portion, and edge portions sized for mutual engagement with the edge portions of the other of the pieces, such that when so engaged, said wall defining portions and said edge portions form said plurality of of chambers.

3. A whistle as is claim 2 wherein a first of said molded pieces inculdes said holes, and a second of said pieces includes said second opening.

4. A whistle as in claim 1 or claim 3 wherein each said chamber has a longitudinal dimension and each said hole includes an annular raised portion at the edge of the hole at the intersection of said hole and an outside surface of said whistle, said hole being spaced from the next adjacent hole in the next chamber at a distance along said longitudinal dimension of said chamber, whereby to aid the user thereof to seal said hole by pressing the pad of the users digit against said raised portion to thus seal said hole and permit said chamber into which said hole penetrates to produce said audible tone.

5. A whistle as in claim 1 wherein each said chamber has a different volume, whereby when said whistle is operated, each of said chambers is capable of resonating at a different audible tone.

6. A whistle as in claim 5 wherein each said chamber is of a different length and are parallel to one another, and the hole in each respective chamber is positioned toward an end of the chamber furthest away from said mouthpiece such that the holes are spaced both laterally and longitudinally from one another to place each hole from one another a greater distance than would occur if the holes were arranged at the same position along the chambers.

7. A whistle as in claim 6 wherein said first and second openings in said mouthpiece extend perpendicular to the length of said chambers to span each said chamber and pneumatically interconnect said chambers.

* * * * *